United States Patent [19]

Arney

[11] Patent Number: 4,642,061

[45] Date of Patent: Feb. 10, 1987

[54] PERSONNEL RESCUE APPARATUS FOR USE ON WATER

[76] Inventor: Donald B. Arney, S.E.I., Unit 406, 5940 No. 6 Road, Richmond, British Columbia, Canada, V6V 1Z1

[21] Appl. No.: 689,167

[22] Filed: Jan. 7, 1985

[51] Int. Cl.[4] ..... B63C 9/00

[52] U.S. Cl. ..... 441/83

[58] Field of Search ..... 441/38–40, 441/43, 44, 83; 114/345; 244/137 P

[56] References Cited

U.S. PATENT DOCUMENTS

| | | | |
|---|---|---|---|
| 1,052,323 | 2/1913 | Davis | 114/349 |
| 2,738,939 | 3/1956 | Johnson | 441/83 |
| 3,026,545 | 3/1962 | Brainard | 441/80 |
| 3,176,327 | 4/1965 | Oberth | 441/83 |
| 3,228,044 | 1/1966 | Mattenson | 441/83 |
| 3,421,165 | 1/1969 | Pugh | 441/83 |
| 3,771,750 | 11/1973 | Strayer | 441/83 |
| 4,166,462 | 9/1979 | Ellis | 114/338 |
| 4,231,131 | 11/1980 | Young | 114/345 |

FOREIGN PATENT DOCUMENTS

| | | | |
|---|---|---|---|
| 527063 | 7/1956 | Canada | 441/40 |
| 624825 | 9/1978 | U.S.S.R. | 441/83 |

*Primary Examiner*—Galen L. Barefoot
*Assistant Examiner*—Jesus D. Sotelo
*Attorney, Agent, or Firm*—Carver & Co.

[57] ABSTRACT

Rescue apparatus for rescuing a person in water has a body with inflatable pontoons interconnected by upper and lower frames to provide an opening between the pontoons to receive the person. Thrusters cooperate with the lower frame below the surface, and receive power and control signals to control movement of the apparatus on the surface. A net enclosure encloses the pontoons and frames and has an opening adjacent one end to receive the person. The upper portion of the apparatus is lighter than the lower portion, preferably by having the upper frames inflatable, to provide a low center of gravity for self-righting if the apparatus becomes inadvertently inverted. The lower frame can include two generally U-shaped frame members which are shaped to fit one within the other to reduce storage volume of the collapsed apparatus when the pontoons are deflated. The apparatus is designed for storage within a helicopter, and can be retrieved from the water by a helicopter with a lifting line positioned so as to permit relatively easy unloading of the person from the apparatus into the helicopter. The apparatus can be used also from ships, oil drilling rigs etc.

11 Claims, 6 Drawing Figures

FIG. 3
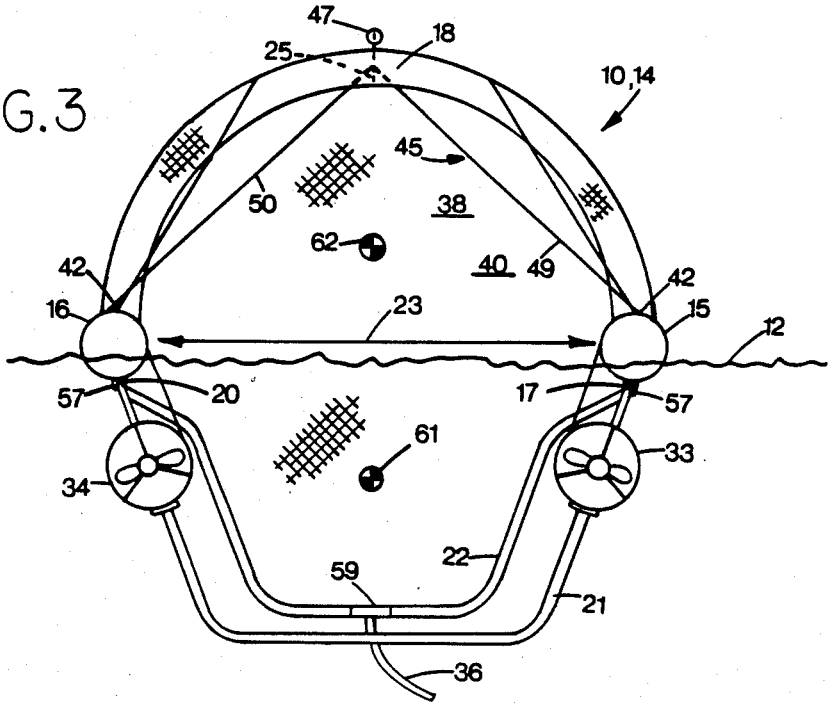
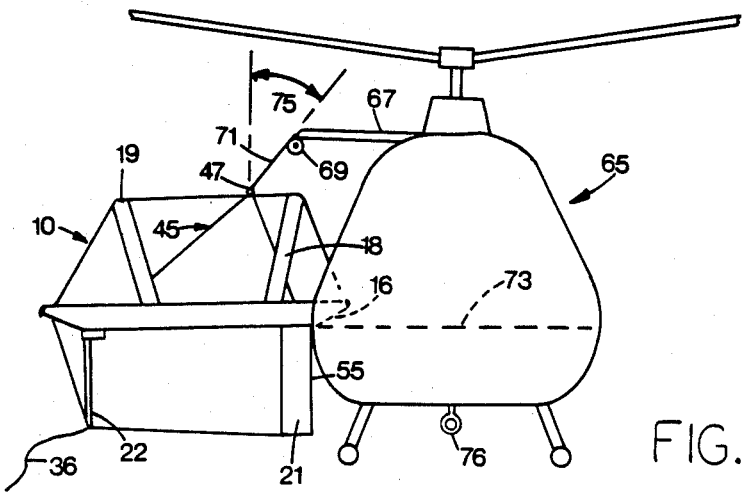
FIG. 4

PERSONNEL RESCUE APPARATUS FOR USE ON WATER

BACKGROUND OF THE INVENTION

1. Field of the Invention

The invention relates to a rescue apparatus for rescuing a person in water, particularly for use in adverse weather and sea conditions where conventional rescue craft cannot operate very effectively.

2. Prior Art

Rescue of personnel in adverse weather and sea conditions has always presented difficulties. Conventional rigid or inflatable lifeboats are commonly difficult to manoeuver for retrieving a floating victim, and in fact sometimes are hazardous to the floating victim. Helicopters have been used to lower rescue personnel, or nets, to retrieve victims, but severe weather conditions endanger the rescue personnel and would commonly prohibit the use of helicopters for this type of rescue.

Russian Pat. No. 624,825 discloses a remotely powered and controlled, unmanned floating rescue net which is designed to retrieve a victim from the water by catching the victim in the forward portion of the net, and returning the victim to a rescue vessel. The apparatus of this patent discloses a rigid framework which supports upper and lower portions of a net, with thrusters mounted on each side for controlling and powering the apparatus. The apparatus has remotely inflatable chambers positioned below the lower portion of the net, which chambers are normally deflated so as to permit the net to pass underneath the victim, and are then inflated to raise the victim with the net. The apparatus is disclosed for use with a helicopter, but it has a hollow metal frame for containing compressed air and does not appear to be collapsible, and thus would require a relatively large and powerful helicopter for operation. Furthermore, there appears to be no automatic self-righting tendency for the apparatus and should it become inverted in heavy seas or during deployment there may be considerable difficulty in setting it upright again. Furthermore, the heavy frame could be a hazard to the victim in adverse sea conditions where the apparatus could be thrown on top of the victim by large waves.

SUMMARY OF THE INVENTION

The invention reduces the difficulties and disadvantages of the prior art by providing a rescue apparatus which is relatively lightweight, and thus can be deployed and retrieved by a helicopter which is less powerful than that required for use with the prior art Russian apparatus. Furthermore, certain components of the apparatus are inflatable, which permits easy collapsing of the apparatus to reduce storage volume, which permits the apparatus to be stored inside a small helicopter for transportation to the rescue site. Clearly, the use of inflatable structure provides automatic flotation and reduces considerably weight of the apparatus, thus presenting less hazard to the victim. Also, the apparatus is designed so that relatively heavy portions are disposed below the water surface, and lightweight portions are disposed above the water surface, thus providing an automatic, self-righting tendency, should the apparatus be temporarily inverted. The loaded apparatus can be hoisted up to the helicopter, and the victim removed with little tendency for the apparatus to move away from the helicopter.

A rescue apparatus according to the invention is for rescuing a person on the surface of a body of water and has a body, thrusters and a net enclosure. The body has laterally spaced parallel, first and second elongated inflatable pontoons, and upper and lower connecting means interconnecting the pontoons. The upper and lower connecting means are bowed upwardly and downwardly respectively to provide an opening between the pontoons to receive the person. The body also has flotation means cooperating with the upper connecting means to assist in self-righting should the apparatus tip. First and second thrusters cooperate with the lower connecting means so as to be sufficiently below and adjacent the first and second pontoons respectively, to provide a relatively low gravity for the body to resist tipping and to assist in self-righting should the apparatus tip. The thrusters are adapted to be below the surface and to receive power and control signals to control movement of the apparatus on the surface. The net enclosure encloses the pontoon and the connecting means and has an opening adjacent at least one pair of adjacent ends of the pontoons to receive the person.

In one embodiment, the upper connecting means includes axially spaced forward and aft inflatable arch members, and the lower connecting means includes axially spaced forward and aft generally U-shaped frame members which are rigid and shaped so as to fit one within the other to reduce storage volume of the collapsed apparatus when the pontoons and arch members are deflated. An umbilical power cable is attached to the aft frame member of the apparatus to power and control the thrusters which are mounted on opposite portions of the forward frame member and are faired with the frame member to reduce chances of the umbilical cable accidentally interfering with the thrusters.

A detailed disclosure following, related to drawings, describes a preferred embodiment of the apparatus, which is capable of expression in structure other than that particularly described and illustrated.

DESCRIPTION OF THE DRAWINGS

FIG. 3 is a simplified front elevation of the apparatus of FIG. 1, shown inflated, FIG. 4 is a simplified front view of the apparatus shown supported by and adjacent a helicopter.

DETAILED DISCLOSURE

Figure 1:
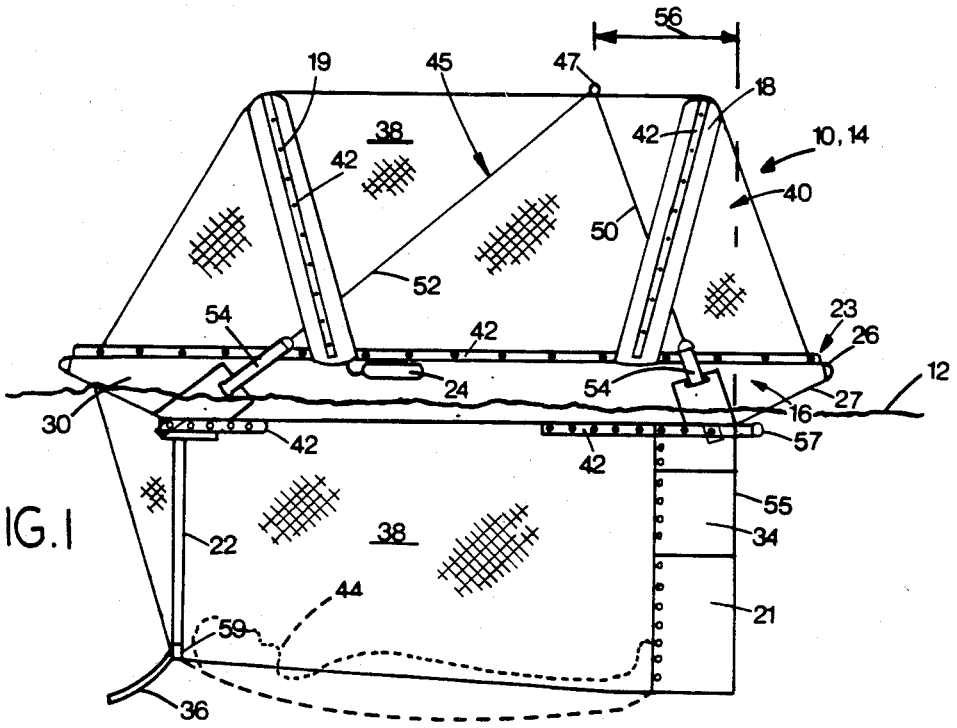
FIG. 1 is a simplified side elevation of the apparatus according to the invention, shown inflated.
Figure 2:
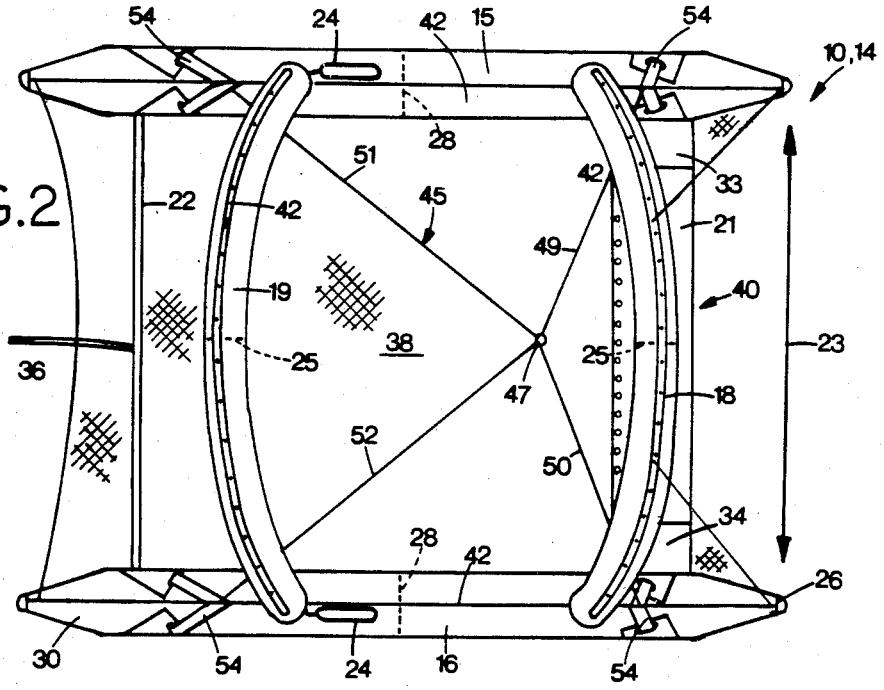
FIG. 2 is a simplified top plan view of the apparatus of FIG. 1, shown inflated.

FIGS. 1 through 3

A rescue apparatus 10 according to the invention is shown floating on the surface 12 of a body of water. The apparatus has a body 14 having a laterally spaced, first and second elongated inflatable pontoons 15 and 16 respectively. The body also has axially spaced, forward and aft inflatable arch members 18 and 19 which are generally similar and are bowed upwardly and interconnect the pontoons, as best seen in FIG. 3. The apparatus has axially spaced forward and aft lower frame members or connecting members 21 and 22 which are rigid and generally U-shaped so as to fit one within the other as will be described. As shown, the forward frame member 21 is larger than the aft frame member 22 so as to permit the member 22 to fit within the member 21 when required for storage. It can be seen that the members 18 and 19, and 21 and 22, provide upper and lower frame means or connecting means respectively which interconnect the pontoons and are bowed upwardly and downwardly respectively to provide an opening 23 between the pontoons to receive the person, not shown. The opening 23 can be about 2 metres wide to receive a person floating horizontally and transversely of the apparatus. The inflatable arch members 18 and 19 communicate with the pontoons so as to receive pressurized air from the pontoons, the pontoons receiving pressurized air from compressed gas bottles 24 secured to the pontoons. The arch members and pontoons are fitted with internal baffles 25 and 28 respectively, shown in broken outline, to form four separate compartments which are sealed from each other. Each compartment is inflatable through a splitter valve connected to the respective adjacent compressed gas bottle. Following common practice, each compartment has a relief valve and a top up/dump valve, none of the valves being shown. The pontoon 16 has a forward portion 26 with an upwardly and forwardly extending prow portion 27, shaped to resemble the forward portions of conventional inflatable boats. The pontoon 16 has a similarly shaped rear portion 30. The pontoon 15 is generally similar to the pontoon 16, and it can be seen that the pontoons resemble the pontoons of conventional inflatable boats.

The apparatus has first and second thrusters 33 and 34 mounted on opposite portions of the forward frame member 21 so as to be axially aligned with the apparatus and to be positioned simultaneously below the water surface 12 when the apparatus floats thereon. The thrusters 33 and 34 are positioned so as to be below and adjacent the first and second pontoons 15 and 16 respectively. The thrusters are adapted to receive power and control signals from an umbilical power cable 36, so as to control movement of the apparatus on the surface as will be described. The umbilical power cable is attached to the aft frame member 22 so as to be remote from the opening 23 at the forward portion of the apparatus. As best seen in FIG. 3, the thrusters have hollow cylindrical bodies which are faired with the frame member, so that one half only of thruster projects outwardly from the apparatus, which reduces chances of the umbilical cable accidently interfering with the thrusters. The thrusters have ducted propellers, which are powered by reversible electric motors of nominally about two horsepower each, and are fitted within ducts of about 30 centimetres outside diameter. The thrusters are provided with wire grids over open portions thereof, so as to reduce chances of injury to the person being rescued, and to reduce ingress of seaweed and/or flotsam.

A net enclosure 38 encloses the pontoons and the frame means, i.e., the forward and aft arch members 18 and 19, and the forward and aft lower frame members 21 and 22, and has an opening 40 adjacent the opening 23 between forward portions of the pontoons. The apparatus is illustrated with one opening, which is adjacent to at least one pair of adjacent ends of the pontoons, so as to form a closed-ended tunnel to receive the person, but an apparatus having openings at both ends is envisaged, and might be practical for certain applications. The net is sufficiently strong to resist forces of a person being held within the enclosure, and has a grid size or mesh sufficiently small to reduce chances of a person's finger or limb being trapped within openings of the mesh. Also, the net is secured by lacing means, severally 42, which extend along the pontoons and frame means to secure the net positively where it contacts the pontoons and frame means. The lacing means 42 can be elongated fabric strips extending from the pontoon or arch member and having a row of eyelets to receive string or cord which is threaded through the net to secure the net to the strips. The net is stretched relatively tightly between the frame means and pontoons, and serves as a stiffening structure or shear web to reduce movement, particularly between the relatively flexible inflatable arch members 18 and 19. Similarly, because there is a continuous area of net extending rearwardly from the front frame member 21 to the rear of the pontoons, thrust from the thrusters acting on the frame member is resisted by the net, thus maintaining the frame member 21 in the required essentially perpendicular position as shown in FIG. 1. Thus, the net enclosure serves two purposes, namely for containing a rescued person, and, because it is secured to the upper and lower frame means and the pontoons it also reduces movement between the frame means and the pontoons.

The apparatus 10 is designed to be carried by helicopter, or a hoist extending from the deck of a vessel or other platform, and is provided with a lifting harness 45 fitted with an upper lifting ring 47. The harness 45 includes a pair of forward cables 49 and 50 and a pair of aft cables 51 and 52. The four cables extend from the ring 47 downwardly to respective strapping slings, severally 54, which pass around adjacent portions of the first and second pontoons. The slings diffuse loads into the pontoons, so as to reduce stress and chances of rupture. The relative lengths and positions of the forward and aft cable pairs are such that the lifting ring 47, which serves as a lifting means, is positioned above the upper frame means, and also aft of a leading portion 55 of the forward lower frame member 21 by a spacing 56, The leading portion 55 is also positioned aft of the forward portions, e.g., 26, of the pontoons and this has a particular advantage as will be described with reference to FIG. 4. A forward ring 57 is positioned adjacent the forward portion 26 of the pontoon 16 and a similar ring is fitted on the pontoon 15. A bridle, not shown, can extend as a slack loop between the forward rings to provide an alternative or additional lifting or towing harness.

Being inflatable, the upper frame means are lighter than the lower frame means to provide a relatively low centre of gravity of the body. Ballast 59 is also preferably provided at a lowermost mid-position of the aft lower frame member 22, which, in combination with the relatively heavy thrusters 33 and 34 lowers the centre of gravity of the apparatus to a relatively low position, designated 61 in FIG. 3. Because the centre of gravity is positioned well below the centre of buoyancy, which is positioned approximately at 62, the apparatus has a strong-self-righting tendency, or resistance to being turned upside down, which might otherwise occur if the centre of gravity were higher. In generally, every attempt is made to produce a light apparatus, for easily handling by a helicopter, and to be less of a hazard to the victim. Also, any relatively heavy item should be positioned as far below the waterline as possible to contribute to a low centre of gravity.

FIG. 4

A helicopter 65 has a winch arm 67 extending transversely thereon, and carrying winch means 69 at an outer end thereof. The appartaus 10 is shown hanging from a lifting line 71 which is connected to the ring 47 and extends to the winch, and the forward portion 26 is shown being partially supported on the floor 73 of the cargo hatch of the helicopter. The floor serves as a receiving surface for the forward portions of the pontoons which extend forwardly from the leading portion 55 of the lower frame means. It can be seen that the lifting line 71 is inclined at an angle 75 to the vertical at the ring 47. This angle is dependent on the relative positions of the winch 69, the ring 47 and the leading portion 55 of the lower frame means and is important as this angle generates a resultant horiztonal component of force on the apparatus 10 which tends to hold the apparatus into the helicopter. This is helpful in steadying the apparatus when a person is being unloaded therefrom into the helicopter, which can be done when the helicopter is hovering. Thus the relative position of the leading portion 55 of the lower frame means, which is aft of the forward portion of the pontoons, permits the forward end of the pontoons to be supported on the receiving surface to facilitate unloading of the apparatus, and positioning the lifting means aft of the leading portion 55 produces a force from the lifting line which tends to draw the apparatus forwardly onto the receiving surface, reducing a tendency of the apparatus to swing away from the helicopter. This unloading arrangement is feasible only for use with helicopters which can tolerate relatively high off-axis forces generated by the lateral position of the apparatus 10. Alternatively the apparatus 10 can be hung from the conventional central cargo hook 76 and unloaded onto a flat surface. Clearly a vessel or platform could be fitted with the arm 67 and the winch 69 for rescue without a helicopter.

FIG. 5

As previously stated, the apparatus can be easily folded to occupy a relatively small space for ease of storage, and to permit transportation by a relatively small helicopter. The apparatus is shown with the forward and aft arch members 18 and 19 and both pontoons 15 and 16 partially deflated, and the forward and aft lower frame members 21 and 22 have been moved towards each other prior to folding or nesting. When completely folded, the aft frame member 22 fits closely adjacent and/or within the forward frame member 21, and the pontoons and arch members are folded to produce a compact package which can be fitted within a relatively small helicopter, such as the Bell 206 Jet Ranger, or can be easily stored on the deck of a small vessel, platform etc. The apparatus has a weight of approximately 45 kilogrammes and clearly can be easily transported by a small helicopter or vessel.

FIG. 6

The umbilical power cable 36 extends from motors of the first and second thrusters 33 and 34 to a power supply and motor control box 78. The box can be fitted on a helicopter, platform or rescue vessel and is supplied with electrical power through a supply line 81, which itself receives power from a generator or other supply. The box contains a ground fault breaker 84 which is connected to a transformer rectifier 86 and a rectifier 88. The transformer rectified 86 is connected through lines 90 to a hand held motor control unit 92 which has toggle switches 93 and 94 for the first and second thrusters respectively. The switches are connected through lines 95 to on/off, forward and reverse relays 96 and 97 which are directly connected to the umbilical power cable 36, and are supplied with power through a line 98 from the rectifier 88.

It is considered that the umbilical cable would be approximately 30 to 50 metres long, so as to provide sufficient maneverability from the rescue vessel or helicopter. For this length of line, it has been found that power supply voltages of the order of 110 volts are preferred, so as to reduce line losses. Each motor has forward, neutral and reverse modes for maneuvering, and clearly the thrusters can be operated simultaneously in opposite directions in a manner similar to operating a twin track crawler vehicle, for steering by rotating about a vertical axis of the apparatus.

OPERATION

Figure 5:
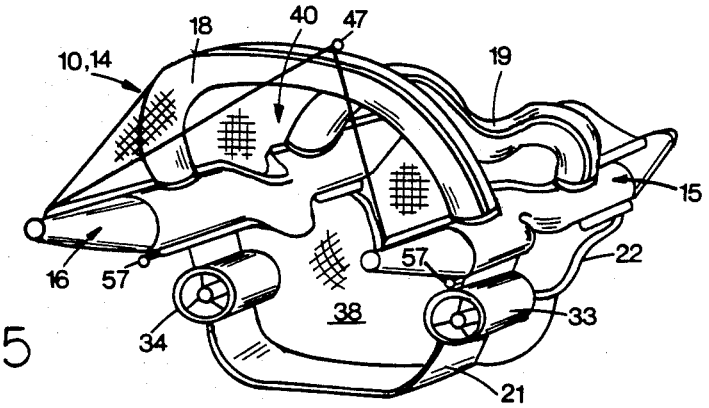
FIG. 5 is a simplified perspective of the apparatus, after partial deflation shown in a partially collapsed state.
Figure 6:
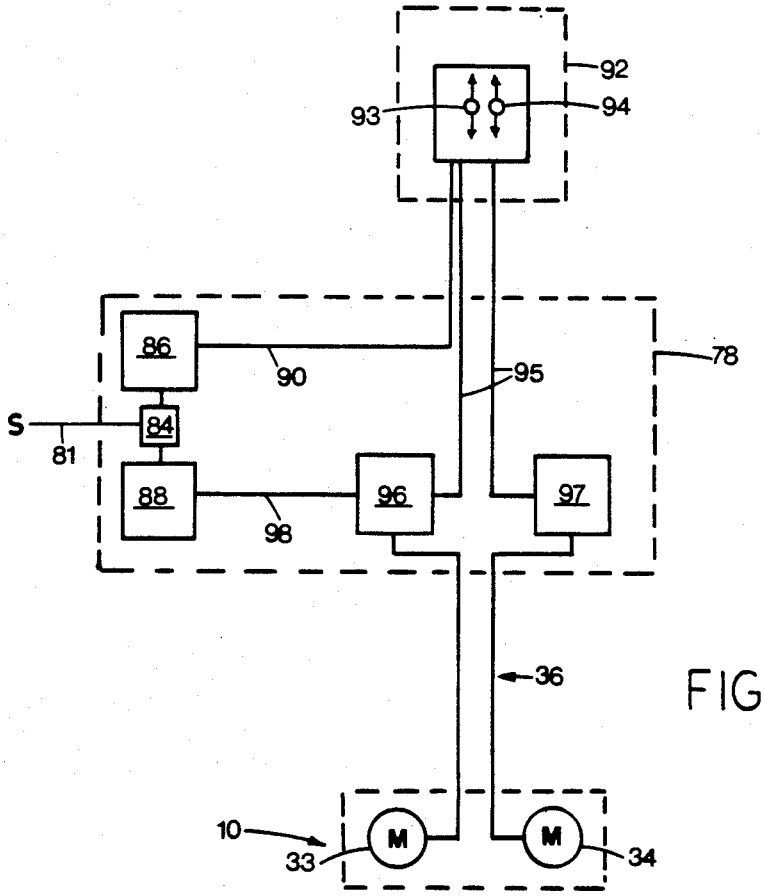
FIG. 6 is a simplified electrical schematic of power and control means for use with the invention.

The apparatus would normally be carried folded on the deck of the vessel or the helicopter to the scene of a rescue. If the vessl or helicopter is sufficiently large, the apparatus is inflated on board and then lowered onto the water. Alternatively, the apparatus could be deployed by lowering it deflated from the vessel or helicopter, and inflating it remotely when on the surface. The line 71 and umbilical cable 36 are provided with sufficient slack to enable maneuvering as required. The umbilical cable 36 extends from the appartus to the hand held motor controls in the helicopter, and the onboard operator directs the movement of the apparatus towards the person in the water. There is no requirement for changing flotation of the apparatus as it "catches" the person, thus contrasting with the prior art Russian device. The operator merely maneuvers the apparatus so that the person passes through the opening 23, which has sufficient vertical depth e.g. about 1.5 metres to accommodate a person floating in the normal partially inclined position. It is added that the lower portion of the forward frame member 21 is positioned to engage the person so inclined at a position about halfway below the thigh or even lower. When the person has passed into the net enclosure itself, the winch 69 is actuated and the person and apparatus are hauled upwards to the helicopter. The apparatus is positioned as shown in FIG. 5 to enable relatively easy removal of the victim from the apparatus. Normally, the apparatus would be tethered by additional lines extending from the forward rings 57 to the helicopter, not shown, to prevent the apparatus from being accidentally pushed away from the helicopter, although the relative positions of the lifting hook and leading portion 55 tend to hold the apparatus into the helicopter. Alternatively, the appartus could be lifted onto the vessel using the ring 47, or the slack bridle extending between the two forward rings 57 in which a winch line is connected to the bridle.

What is claimed is:

1. A rescue apparatus for rescuing a person on the surface of a body of water, the apparatus having:

(a) a body having laterally spaced, parallel, first and second elongated inflatable pontoons, and upper and lower connecting means interconnecting the pontoons, the pontoons having forward portions with upwardly and forwardly extending prow portions, the upper and lower connecting means being bowed upwardly and downwardly respectively to provide an opening between the pontoons to receive the person, the lower connecting means having a leading portion positioned aft of the forward portions of the pontoons to permit the forward portions of the pontoons to be supported on a receiving surface to facilitate unloading of the apparatus, the body also having flotation means cooperating with the upper connecting means to assist in self-righting should the apparatus tip, (b) first and second thrusters cooperating with the lower connecting means so as to be sufficiently below the first and second pontoons respectively to provide a relatively low centre of gravity for the body to resist tipping and to assist in self-righting should the apparatus tip, the thrusters being adapted to be below the surface and to receive power and control signals to control movement of the apparatus on the surface, (c) a net enclosure enclosing the pontoons and the connecting means, the net enclosure having an opening adjacent the forward portions of the pontoons to receive the person.

2. An apparatus as claimed in claim 1 in which:

(a) the lower connecting means is rigid.

3. An apparatus as claimed in claim 2 in which:

(a) The upper connecting means includes axially spaced forward and aft inflatable arch members, and the lower connecting means includes axially spaced, forward and aft generally U-shaped frame members which are shaped so as to fit adjacent each other to reduce storage volume of the collapsed apparatus when the pontoons and arch members are deflated.

4. An apparatus as claimed in claim 1 further including:

(a) a lifting means positioned above the upper connecting means and aft of the leading portion of the lower connecting means, so that, when the apparatus is suspended from a lifting line acting from above the receiving surface, force from the lifting line tends to draw the apparatus forwardly on to the receiving surface.

5. An apparatus as claimed in claim 1 in which:

(a) the net enclosure is secured to the upper and lower connecting means and the pontoons to reduce movement between the connecting means and the pontoons.

6. An apparatus as claimed in claim 1 in which:

(b) ballast is provided at a lowermost portion of the lower connecting means to lower the centre of gravity of the appartus.

7. A rescue apparatus for rescuing a person on the surface of a body of water, the apparatus having:

(a) a body having laterally spaced, parallel, first and second elongated inflatable pontoons, and upper and lower connecting means interconnecting the pontoons, the upper and lower connecting means being bowed upwardly and downwardly respectively to provide an opening between the pontoons to receive the person, the lower connecting means including forward and aft generally U-shaped frame members, the body also having flotation means cooperating with the upper connecting means to assist in self-righting should the apparatus tip, (b) first and second thrusters cooperating with the lower connecting means so as to be sufficiently below the first and second pontoons respectively to provide a relatively low centre of gravity for the body to resist tipping and to assist in self-righting should the apparatus tip, an umbilical power cable being attached to the apparatus to power and control the thrusters, the thrusters being adapted to be below the surface and to receive power and control signals from the umbilical cable to control movement of the apparatus on the surface, the thrusters being mounted on opposite portions of the forward frame member so as to be axially aligned with the apparatus and to be faired with the frame member to reduce chances of the umbilical cable accidentally interfering with the thrusters, (c) a net enclosure enclosing the pontoons and the connecting means, the net enclosure having an opening adjacent at least one pair of adjacent ends of the pontoons to receive the person.

8. An apparatus as claimed in claim 7 in which:

(a) the opening of the net enclosure is adjacent the forward frame member, (b) the umbilical power cable is attached to the aft frame member so as to be remote from the opening of the net enclosure.

9. A rescue apparatus for rescuing a person on the surface of a body of water, the apparatus having:

(a) a body having laterally spaced, parallel first and second elongated inflatable pontoons, and axially spaced forward and aft inflatable arch members interconnecting the pontoons, and axially spaced forward and aft generally U-shaped frame members interconnecting the pontoons, the arch members and the frame members being bowed upwardly and downwardly respectively to provide an opening between the pontoons to receive the person, the arch members providing flotation to assist in self-righting should the apparatus tip, and the U-shaped frame members being shaped so as to fit adjacent each other to reduce storage volume of the collapsed apparatus when the pontoons and the arch members are deflated, (b) first and second thrusters cooperating with one of the U-shaped frame members so as to be below and adjacent the first and second pontoons respectively, and simultaneously below the water surface when the apparatus floats thereon to provide a relatively low center of gravity for the body to resist tipping and to assist in self-righting should the apparatus tip, the thrusters being adapted to receive power and control signals to control movement of the apparatus on the surface, (c) a net enclosure enclosing the pontoons, the arch members and the U-shaped frame members, the net enclosure having an opening adjacent at least one pair of adjacent ends of the pontoons to receive the person.

10. A rescue apparatus for rescuing a person on the surface of a body of water, the apparatus having:

(a) a body having laterally spaced, parallel, first and second elongated inflatable pontoons, and upper and lower connecting means interconnecting the pontoons, the upper and lower connecting means being bowed upwardly and downwardly respectively to provide an opening between the pontoons to receive the person, the upper connecting means being inflatable to assist in self-righting should the apparatus tip, (b) first and second thrusters cooperating with the lower connecting means so as to be sufficiently below the first and second pontoons respectively to provide a relatively low centre of gravity for the body to resist tipping and to assist in self-righting should the apparatus tip, the thrusters being adapted to be below the surface and to receive power and control signals to control movement of the apparatus on the surface, (c) a net enclosure enclosing the pontoons and the connecting means, the net enclosure having an opening adjacent at least one pair of adjacent ends of the pontoons to receive the person.

11. An apparatus as claimed in claim 10 further including:

(a) compressed air inflation bottle means mounted on the apparatus to inflate the pontoons.

* * * * *